US006674410B1

(12) United States Patent
Davidovitz

(10) Patent No.: US 6,674,410 B1
(45) Date of Patent: Jan. 6, 2004

(54) SIX-PORT JUNCTION/DIRECTIONAL COUPLER WITH 0/90/180/270 ° OUTPUT PHASE RELATIONSHIPS

(75) Inventor: Marat Davidovitz, Belmont, MA (US)

(73) Assignee: The United States of America as represented by the Secretary of the Air Force, Washington, DC (US)

( * ) Notice: Subject to any disclaimer, the term of this patent is extended or adjusted under 35 U.S.C. 154(b) by 77 days.

(21) Appl. No.: 10/150,819

(22) Filed: May 15, 2002

(51) Int. Cl.[7] ..... H01Q 1/50

(52) U.S. Cl. ..... 343/850; 343/700 MS; 342/373

(58) Field of Search ..... 343/700 MS, 850, 343/860; 333/24 R, 24.1, 25; 342/373, 375

(56) References Cited

U.S. PATENT DOCUMENTS

| | | | | | |
|---|---|---|---|---|---|
| 5,216,430 | A | * | 6/1993 | Rahm et al. | 343/700 MS |
| 6,057,806 | A | * | 5/2000 | Lopez | 343/890 |
| 6,127,974 | A | * | 10/2000 | Kesler | 342/417 |
| 6,167,286 | A | * | 12/2000 | Ward et al. | 455/562.1 |
| 6,208,313 | B1 | * | 3/2001 | Frank et al. | 343/853 |
| 6,377,558 | B1 | * | 4/2002 | Dent | 370/321 |

* cited by examiner

*Primary Examiner*—Tan Ho
(74) *Attorney, Agent, or Firm*—William G. Auton

(57) ABSTRACT

A single six-port device which can be used to excite antenna elements in dual polarization mode. It can replace more complex feed arrangements containing up to three separate components. One version of the six port device is made up of a network of transmission lines connected in parallel. Another six-port device implementation is a network of transmission lines connected in series. Both versions can feed antenna elements to simultaneously transmit/receive dual orthogonal linear or circular polarizations.

1 Claim, 8 Drawing Sheets

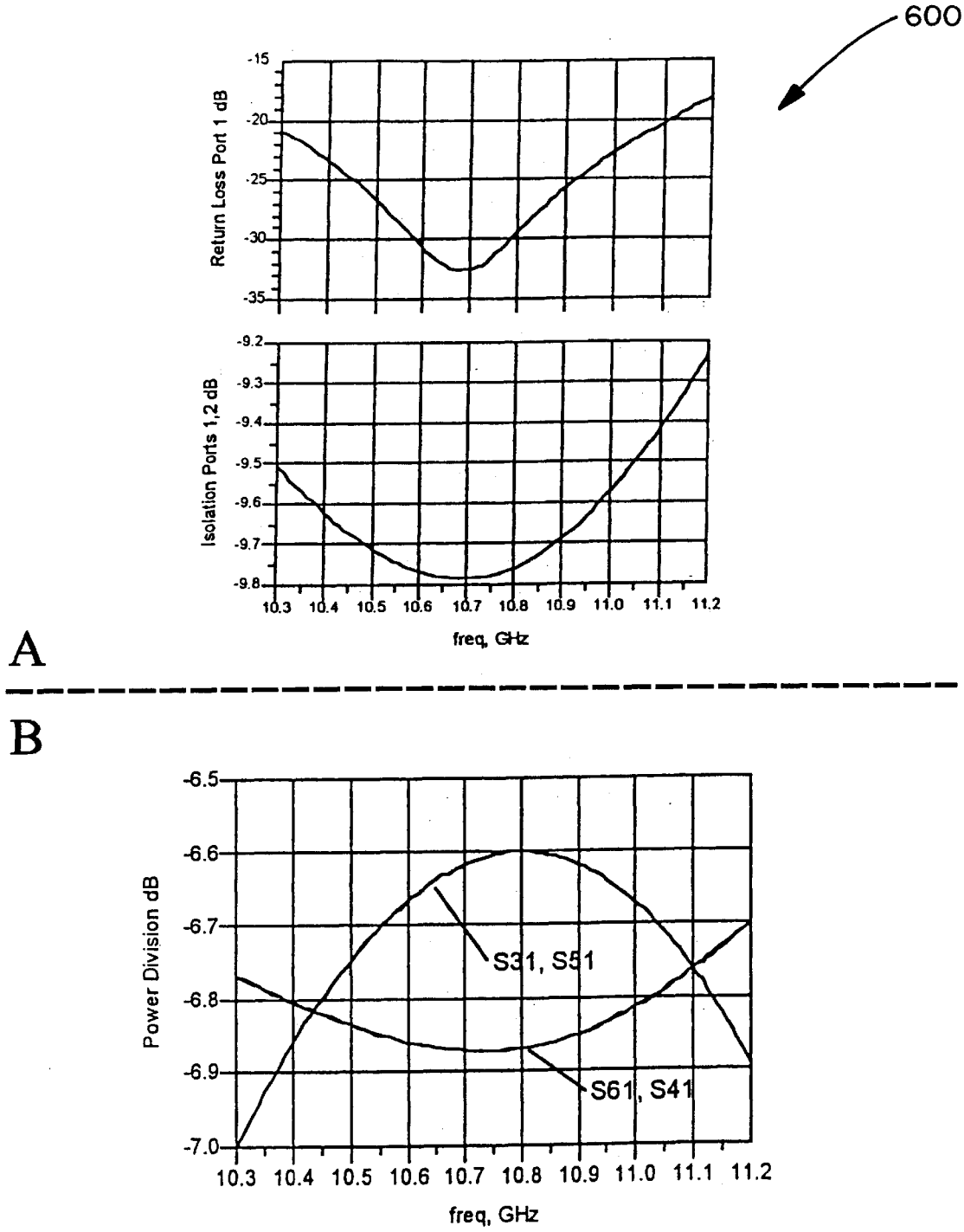
FIG. 6 A-B

SIX-PORT JUNCTION/DIRECTIONAL COUPLER WITH 0/90/180/270 ° OUTPUT PHASE RELATIONSHIPS

STATEMENT OF GOVERNMENTAL INTEREST

The invention described herein may be manufactured and used by and for the Government for governmental purposes without the payment of any royalty thereon.

BACKGROUND OF THE INVENTION

The present invention relates generally to phased arrays, particularly those used for high-rate data communications, require antenna elements to simultaneously transmit/receive dual orthogonal linear or circular polarizations, and more specifically to a single six-port device, which can be used to excite antenna elements in dual polarization mode.

Modern phased arrays, particularly those used for high-rate data communications, require antenna elements to simultaneously transmit/receive dual orthogonal linear or circular polarizations. Moreover, the polarization purity must be very high over the array scan range to ensure adequate isolation of the cross-polarized channels. The preferred phased array antenna embodiment for many state-of-the-art systems is based on the planar printed circuit, primarily microstrip, technology. A complex feed network is needed in order to produce microstrip antenna elements capable of radiating dual circular polarizations over a significant scan range. The invention describes a single six-port device, which can be used to excite antenna elements in a dual polarization mode. It can replace more complex feed arrangements containing up to three separate components.

SUMMARY OF THE INVENTION

The present invention is a single six-port device, which can be used to excite antenna elements in a dual polarization mode. It can replace more complex feed arrangements containing up to three separate components. One version of the six port device is made up of a network of transmission lines connected in parallel. Another six-port device implementation is a network of transmission lines connected in series. Both versions can feed antenna elements to simultaneously transmit/receive dual orthogonal linear or circular polarizations.

DESCRIPTION OF THE DRAWINGS

FIG. 6*a* is a chart of the port 1 return loss and isolation from port 2 of the present invention;

FIG. 6*b* is a chart of the power division between ports 3, 4, 5, 6 of the present invention;

DETAILED DESCRIPTION OF THE PREFERRED EMBODIMENT

The present invention is a single six-port device, which can be used to excite antenna elements in a dual polarization mode. It can replace more complex feed arrangements containing up to three separate components. One version of the six port device is made up of a network of transmission lines connected in parallel. Another six-port device implementation is a network of transmission lines connected in series. Both versions can feed antenna elements to simultaneously transmit/receive dual orthogonal linear or circular polarizations.

Figure 1:
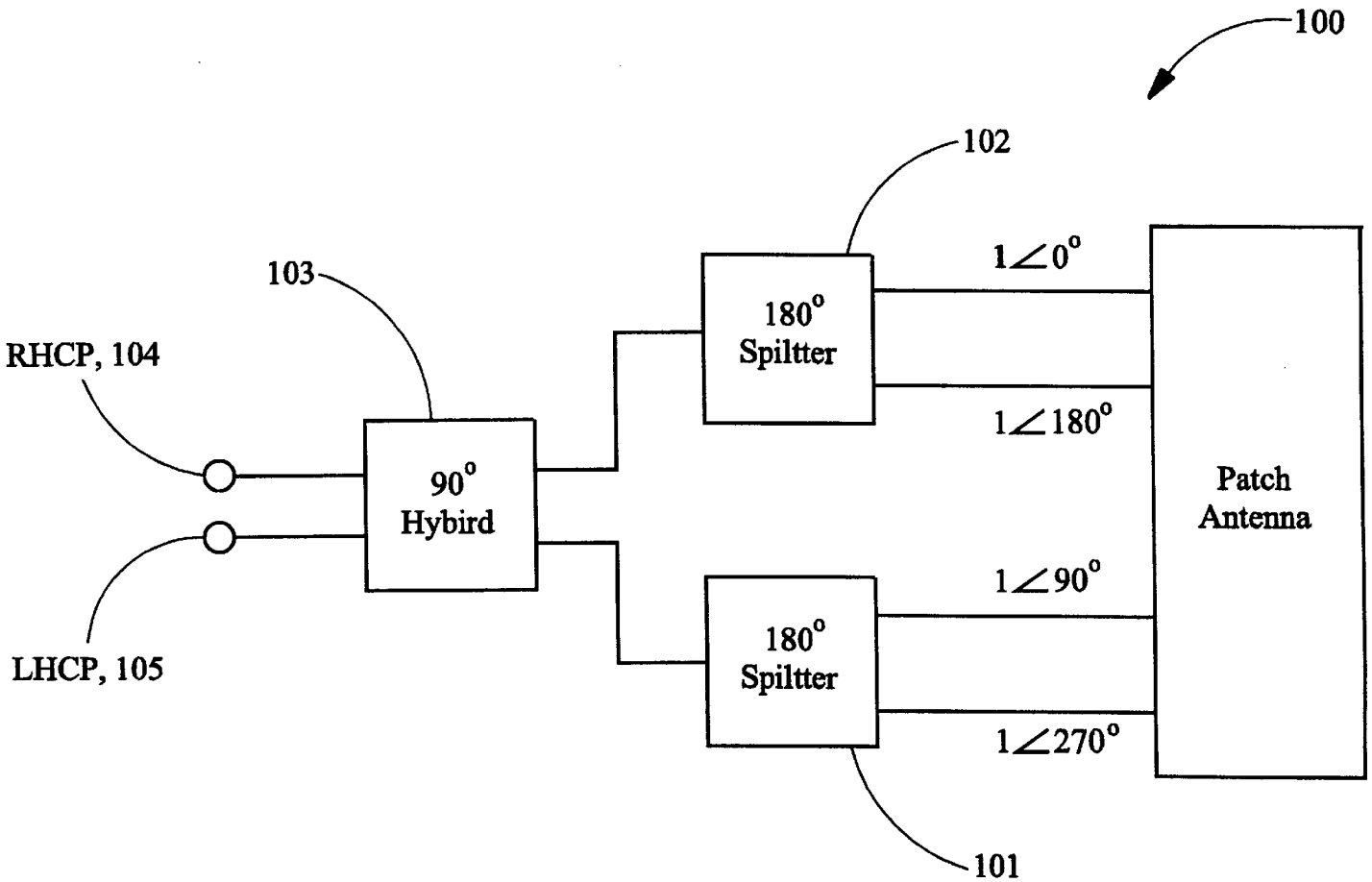
FIG. 1 shows a conventional balanced feed network for dual circular polarization.

A network commonly used to provide balanced feed for dual circular polarization (CP) to a microstrip patch antenna element is diagrammed in FIG. 1. FIG. 1 shows a conventional balanced feed network for dual circular polarization.

The two 180° Splitters, typically rat-race hybrids (magic-T's) divide the signal into equal, out-of-phase portions to produce orthogonal linearly polarized components. The 90° hybrid mixes the linear constituents to produce orthogonal right- and left-handed circular polarizations (RHCP and LHCP).

The proposed invention introduces a single device with input-output properties identical to those of the network in FIG. 1. Several circuit topologies are produced and physical implementations using many widely used transmission lines are described. The ideal scattering (S-) matrix representation of the input-output properties for the proposed six-port device is $$S = 1/2\begin{pmatrix} 0 & 0 & -1 & -I & 1 & I \\ 0 & 0 & I & 1 & -I & -1 \\ -1 & I & 0 & I & 0 & I \\ -I & 1 & I & 0 & I & 0 \\ 1 & -I & 0 & I & 0 & I \\ I & -1 & I & 0 & I & 0 \end{pmatrix}$$

where $I=\sqrt{-1}$.

Figure 2:
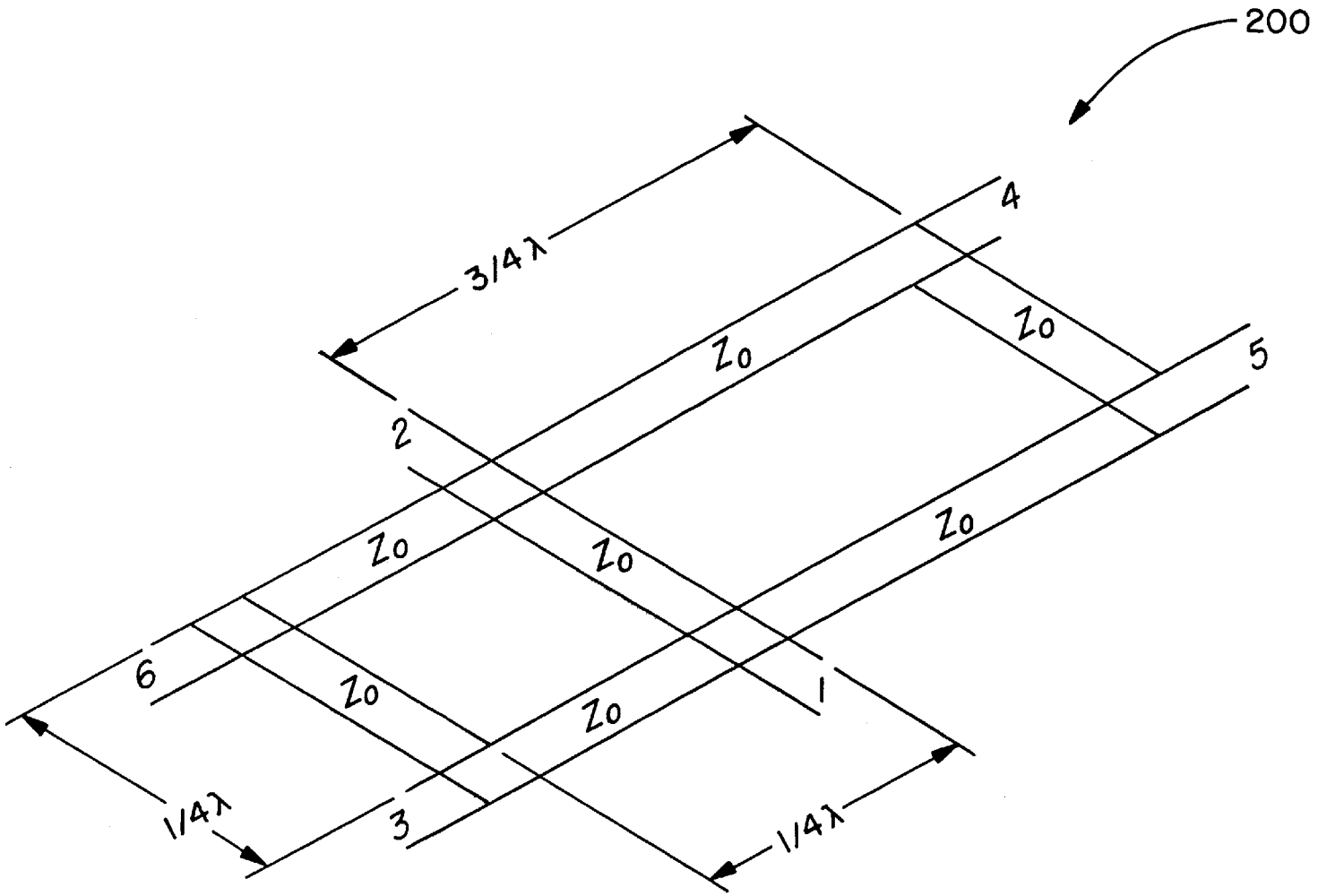
FIG. 2 shows a six-port device implementation as a network of transmission lines connected in parallel.
Figure 3:
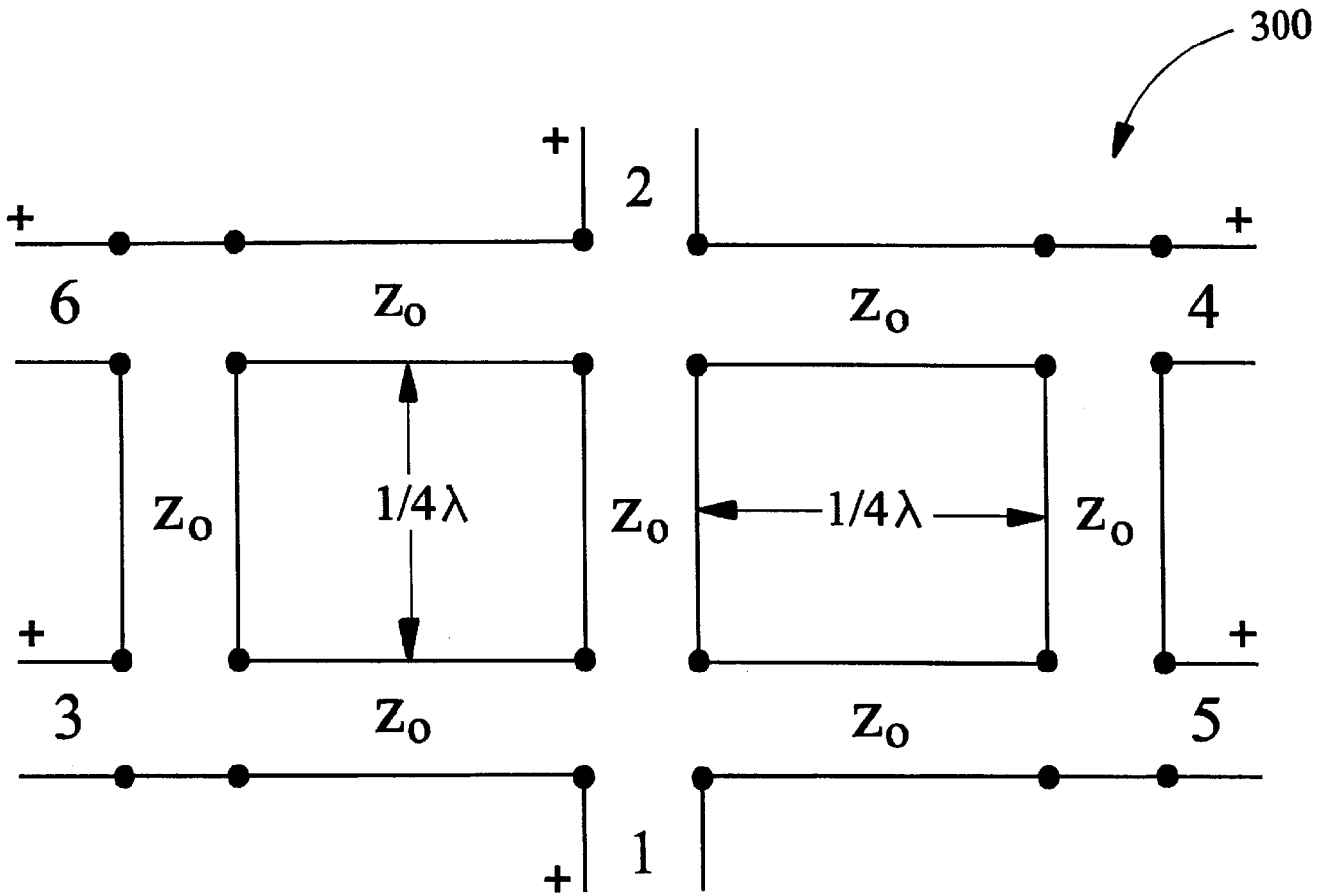
FIG. 3 shows a six-port device implementation as a network of transmission lines connected in series.
Figure 4:
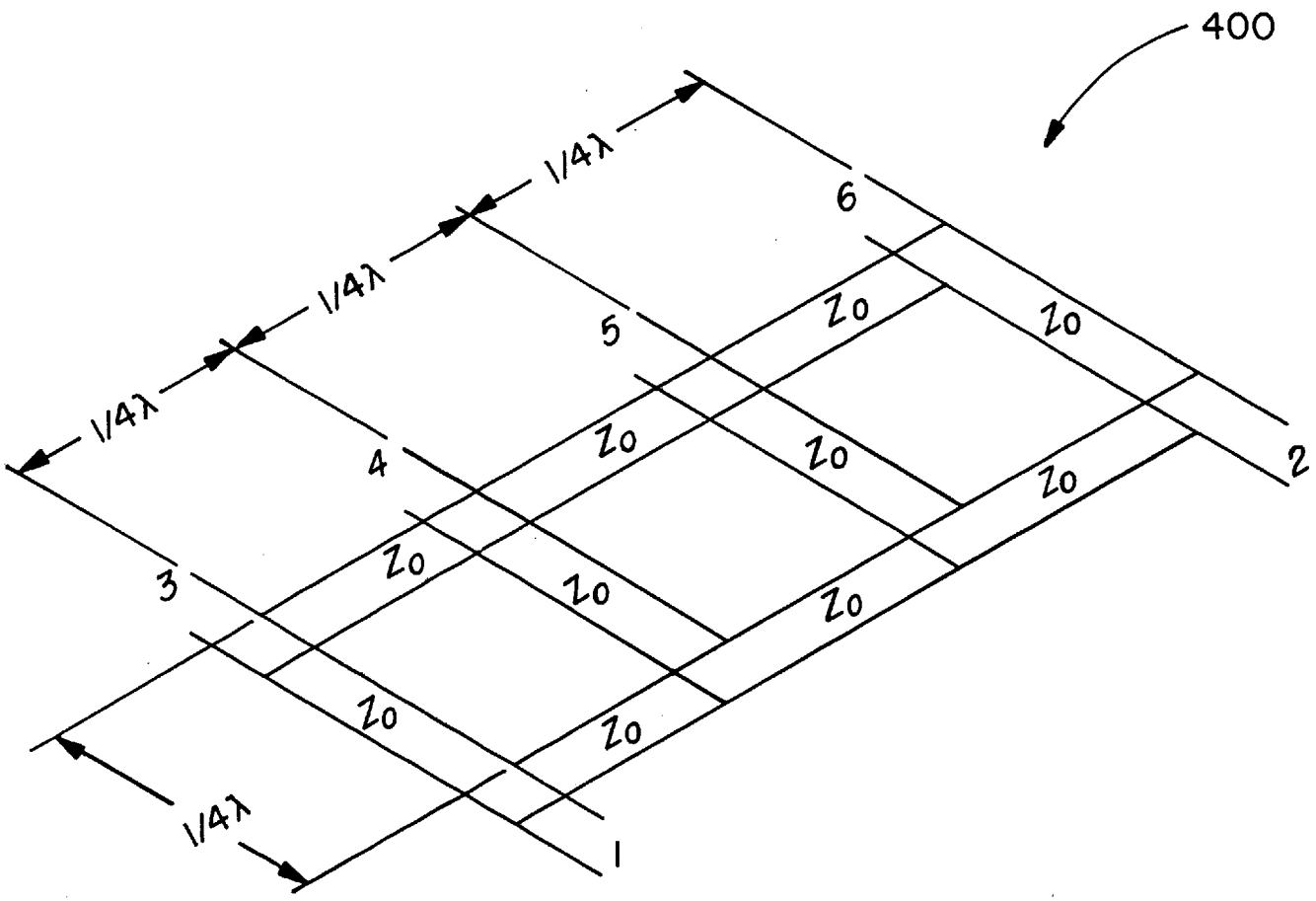
FIG. 4 is a diagram alternate six-port device implementation as a network of transmission lines connected in series of the present invention.

A number of transmission line network topologies characterized by the given S-matrix have been synthesized. The two fundamental implementations in the forms of parallel and series connected lines are shown in FIGS. 2 and 3, respectively. The characteristic impedances of all the lines, including those attached to the ports, are identically $Z_0$. Other network topologies (e.g. FIG. 4), combining parallel, series lines and/or lumped elements are possible.

Figure 5:
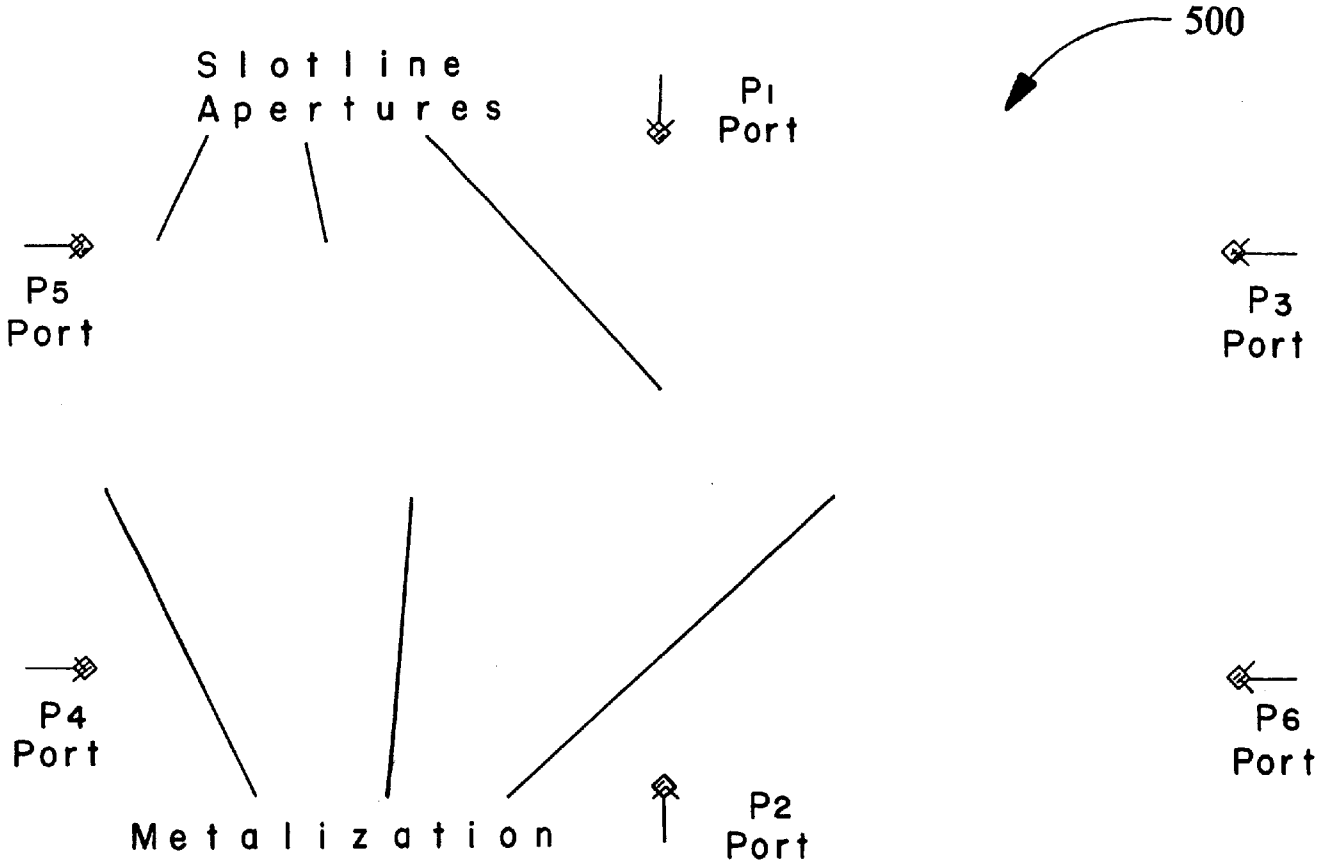
FIG. 5 is a circuit diagram of the layout mask for the slotline implementation of the series-connected six-port junction of the present invention.

Physical implementation of the displayed networks is possible in a variety of transmission line media. They include the standard volumetric types, such as coaxial lines, hollow waveguides (circular, rectangular, etc.), as well as planar lines—microstrip, coplanar waveguide, slotline, etc. A slotline design was carried out to demonstrate feasibility. The slotline naturally lends itself to the series embodiment of the junction, as shown in FIG. 3. The design was analyzed and verified using a commercial full-wave electromagnetic software package Momentum, Agilent Technologies. The physical attributes of the design are presented in FIGS. 5, 6. The solid lines in FIG. 5 represent apertures in a metalization of single-side copper clad microwave printed circuit board. The thickness of the board for this design is 32 mils and the relative permittivity of the dielectric is 2.2.

Figure 6C:
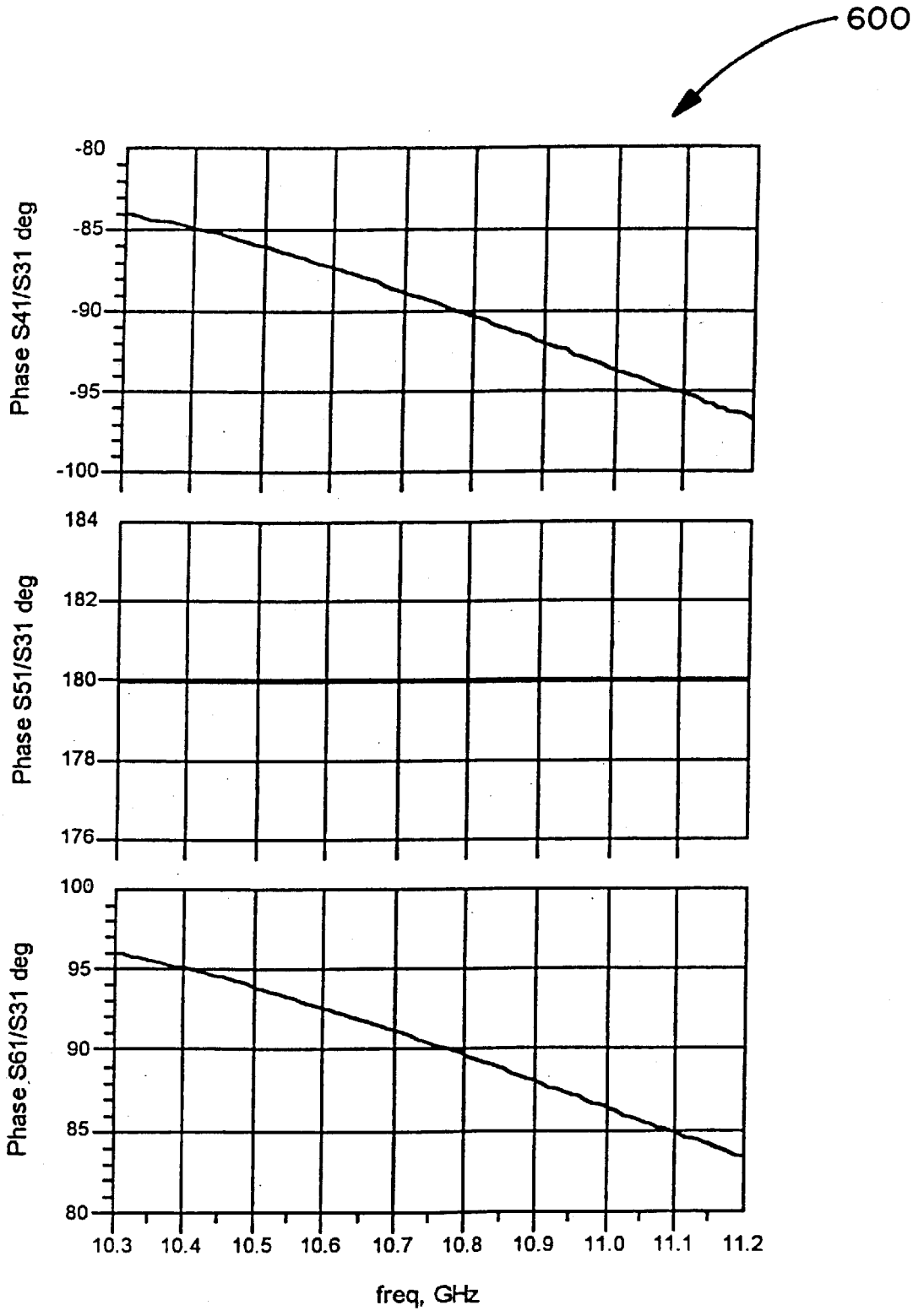
FIG. 6*c* is a chart of the Signal Phases at Ports 4, 5, 6 relative to Port 3 of the present invention.
Figure 6D:
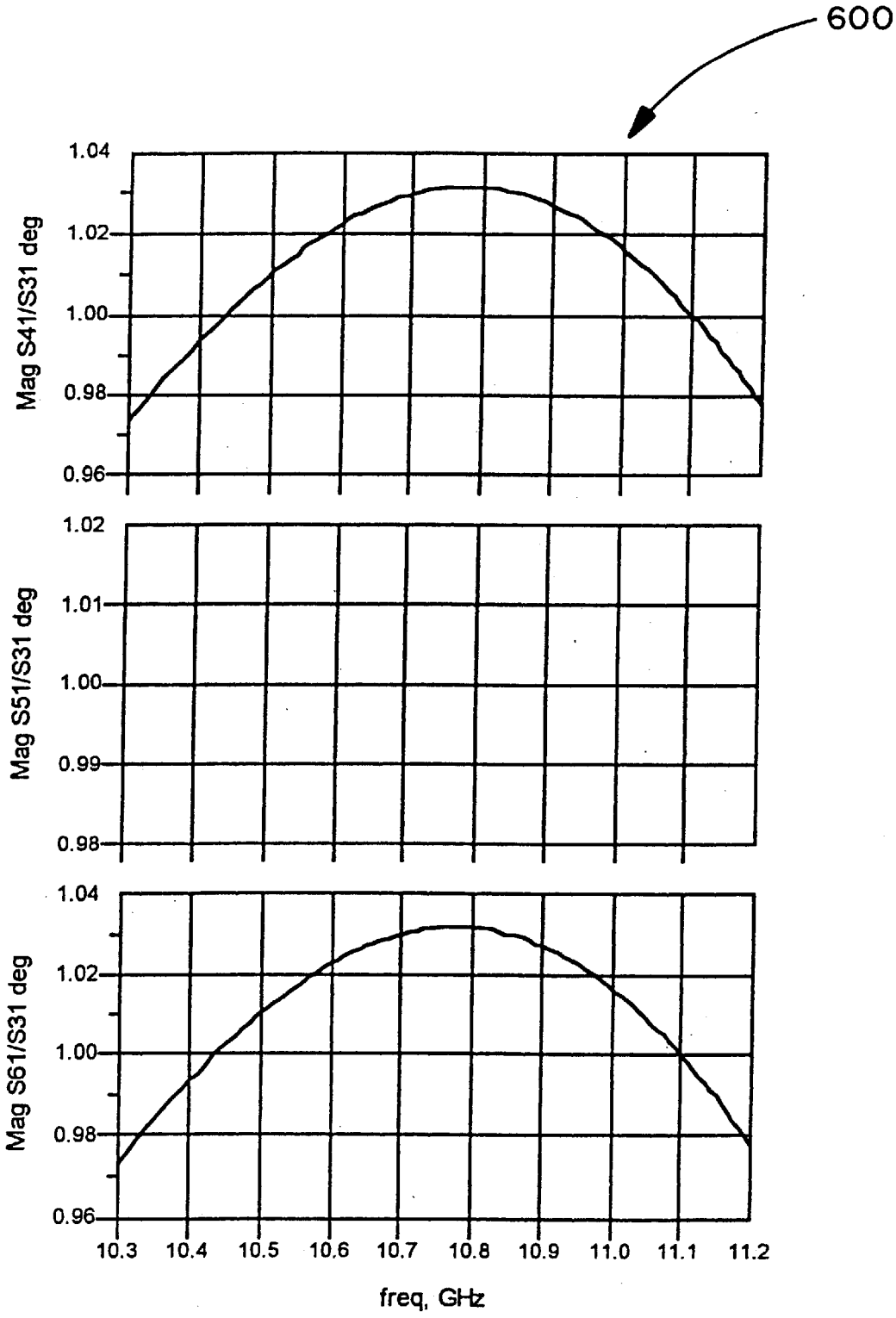
FIG. 6*d* is a chart of the signal amplitude variations at ports 4, 5, 6 relative to Port 3 of the present invention.

The scattering parameters obtained by analyzing this device are presented in FIG. 6. The simulated (using full-wave commercial software) Return Loss (RL) at Port 1 is shown in FIG. 6(*a*), as is the Isolation between Ports 1 and 2. The RL is excellent over at least 10% bandwidth. The isolation is fairly good and can be reduced with additional tweaking. The data for power division among Ports 3, 4, 5, 6 is presented in FIG. 6(*b*). The outputs at these ports are ~6.75±0.15 dB over the band. The required 0/90/180/270° phase relationship is realized over the band with a precision of ±7°, as seen in FIG. 6(*c*). Finally, in FIG. 6(*d*), the variations of signal amplitudes at Ports 4, 5, 6, relative to that at Port 3, is shown. These are at most 3% over the operating band.

While the invention has been described in its presently preferred embodiment it is understood that the words which have been used are words of description rather than words of limitation and that changes within the purview of the appended claims may be made without departing from the scope and spirit of the invention in its broader aspects.

What is claimed is:

1. A single six-port device, which can be used to excite antenna elements in a dual polarization mode, said single six-port device comprising: a six-port transmission circuit network having input/output given by $$S = 1/2\begin{pmatrix} 0 & 0 & -1 & -I & 1 & I \\ 0 & 0 & I & 1 & -I & -1 \\ -1 & I & 0 & I & 0 & I \\ -I & 1 & I & 0 & I & 0 \\ 1 & -I & 0 & I & 0 & I \\ I & -1 & I & 0 & I & 0 \end{pmatrix}$$

where $I=\sqrt{-1}$.

* * * * *